US005295734A

United States Patent [19]

Ilomäki

[11] Patent Number: 5,295,734

[45] Date of Patent: Mar. 22, 1994

[54] METHOD AND APPARATUS FOR DRILLING A TUNNEL

[76] Inventor: Valto Ilomäki, Loilantie 8, SF-33470 Ylöjärvi, Finland

[21] Appl. No.: 838,792

[22] PCT Filed: Sep. 27, 1990

[86] PCT No.: PCT/FI90/00230

§ 371 Date: Mar. 17, 1992

§ 102(e) Date: Mar. 17, 1992

[87] PCT Pub. No.: WO91/05139

PCT Pub. Date: Apr. 18, 1991

[30] Foreign Application Priority Data

Sep. 27, 1989 [FI] Finland ..... 894557

[51] Int. Cl.[5] ..... E21D 9/06

[52] U.S. Cl. ..... 299/32; 405/138; 405/146; 405/143

[58] Field of Search ..... 405/138, 141, 150.1, 405/146, 139; 299/32

[56] References Cited

U.S. PATENT DOCUMENTS

| | | | |
|---|---|---|---|
| 1,993,366 | 3/1935 | Engelbright | 405/184 X |
| 2,669,441 | 2/1954 | Castanoli et al. . | |
| 4,117,895 | 10/1978 | Ward et al. | 405/184 X |
| 4,221,503 | 9/1980 | Cherrington | 405/184 |
| 5,186,579 | 2/1993 | Hanamoto et al. | 405/184 X |

*Primary Examiner*—Dennis L. Taylor
*Attorney, Agent, or Firm*—Larson and Taylor

[57] ABSTRACT

A method for drilling a tunnel in rock which utilizes a drilling apparatus comprising a drill head having tools therein and at least one conveying tube is disclosed. The method utilizes roller units which support the conveying tube to transmit the forward driving force from a power unit at the rear end of the apparatus to the drill head.

9 Claims, 2 Drawing Sheets

METHOD AND APPARATUS FOR DRILLING A TUNNEL

FIELD OF THE INVENTION

The invention relates to a method by which a tunnel drilling apparatus is driven forward, and to an apparatus by which the drive is transmitted forward to the drill head, particularly in driving a tunnel in rock.

BACKGROUND OF THE INVENTION

Previously known from the applicant's earlier invention No. FI-891706 is a method of driving a drilling apparatus forward, wherein the drilling apparatus is forced from the working pit into the tunnel by means of protecting tubes, the driving power unit being in the working pit. The same method is also known from the publication GB-2 157 344.

U.S. Pat. No. 2,669,441 discloses how the drill head is driven forward by means of a protecting tube provided with an internal spiral system which steers excavated material towards the tunnel opening.

Driving the drill head forward by means of protecting tubes, which are to be installed in the tunnel, is applicable to drillings in normal and watery terrains, wherein a protection tube is often an absolute necessity because of landslippage. It is quite clear that driving the drilling apparatus forward by means of protecting tubes is also advantageous since protecting tubes must be forced into the tunnel anyway. On the other hand, a protection tube is not usually needed when drilling into rock, in which case this method is not applicable.

Using a rotating tube for driving an apparatus forward is also applicable for tunnel drilling, but in this case, tee protecting tube is fitted with rotating elements in the rocky wall and the other end of the protecting tube needs at least one great thrust bearing. The joints between the protection tubes, which are arranged sequentially, must be lap joints. In addition, in this case, the directional stability is not the best possible.

SUMMARY OF THE INVENTION

With the method and apparatus of this invention a crucial improvement over said disadvantages has been achieved as presented in the enclosed patent claims.

The main advantage of this invention is that the protecting drum ca be a tube of relatively light construction transmitting only the torsion to the drill head, no thrust bearing is needed in the drive end and the supporting rollers and bearings, needed for the rotating protecting tube, can at the same time function as transmitters of the forward drive.

BRIEF DESCRIPTION OF THE DRAWINGS

The invention is more closely described as follows with reference to the enclosed drawings where.

DESCRIPTION OF THE INVENTION

Figure 1:
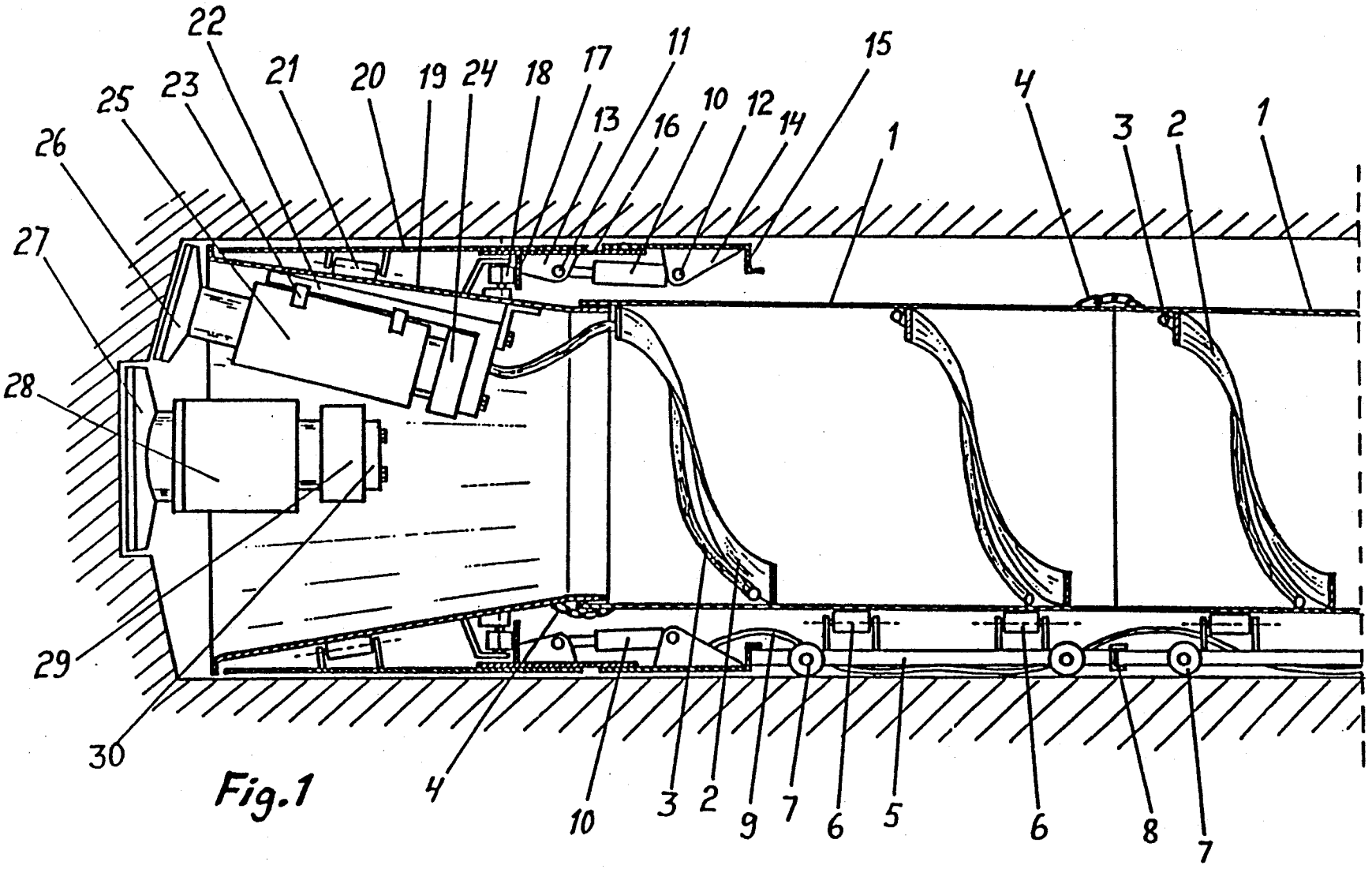
FIG. 1 shows the advance of a drill head in rock.

FIG. 1 shows a drilling apparatus advancing in rock, provided with tools (25,28) with percussion bits (26,27). The tools are supported by medium-driven cylinders (24,29) and the tools can move in their holders (22,30) parallel to their longitudinal axes. The rotating head portion (19) is supported with rollers (21) to the head drum (20). By means of an auxiliary drum (16) the head drum (20) is fitted with a collar ring (17) against which a roller (18) is leaning as a thrust bearing. For drill head steering, the head drum (20) is fitted with steering cylinders (10) attached to holders (13,14) with jointings (11,12). The counterdrum leans against the framework of the rollers (6). The roller units (5) carry rollers (6) which support the conveying tubes (1) and have wheels (7) for driving them forward. The conveying tubes (1) are provided with spiral ribbing (2) The drilling apparatus is provided with conveying tubes and rollers arranged in succession. It is advantageous to join these a units of same length one after another. The rollers can be placed in the tunnel bottom section but, in addition, the conveying tubes can also be supported by a plurality of rollers on different places in the tunnel circumference.

Figure 2:
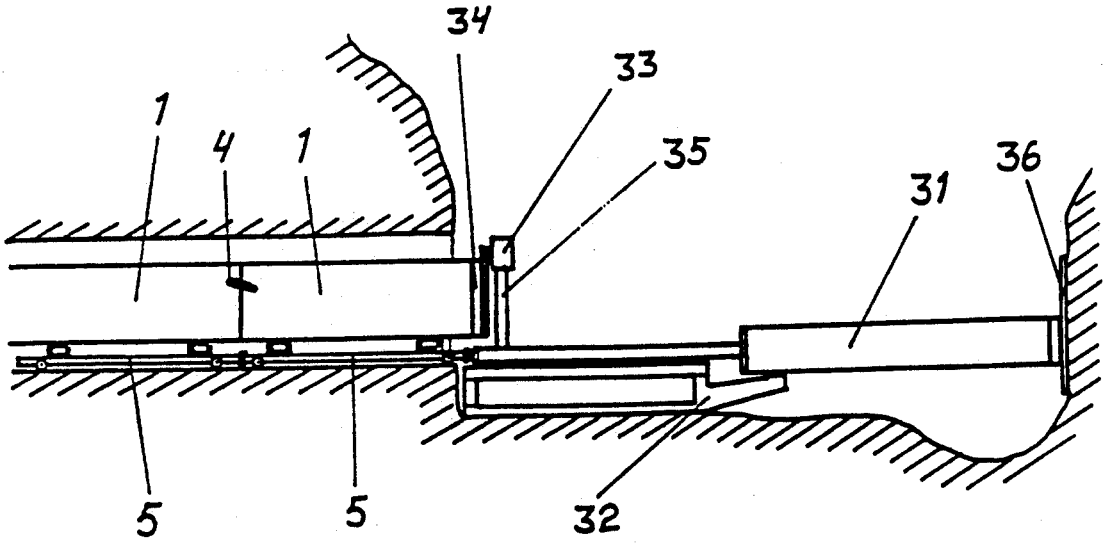
FIG. 2 shows a driving and power-transmitting head in the working pit.

FIG. 2 shows the tunnel opening where conveying tube units and roller units are added as the tunnel advances. The rotary movement is transmitted over chains (4). A motor (33) rotates the conveying tubes by means of a gear rim (34). The motor is secured to framework (32) by means of a supporting arm (35). Roller units (5) are driven forward by a driving cylinder (31) as drilling advances and the driving power is transmitted to the drill head from the roller units (5) by means of drum section (15) and steering cylinders (10) (FIG. 1). The cylinder (31) is supported against the pit back wall with a plate (36).

The roller units arranged one after another, can be provided at their contact points (8) with connecting parts (FIG. 1). They can be joined together for instance so that the rollers can be drawn off the tunnel and at the same time, together with the roller units; also, the entire drilling apparatus can be pulled out in case of damage.

Special attention is to be paid to the fact that the invention is not restricted to the embodiments of the prior art but it can be modified within the limits of the enclosed patent claims. The rollers in the roller units can be replaced with bearing surfaces and the frame dimension of the roller units can be a multiple of the rotating tube length or divisible by its total.

I claim:

1. In an apparatus for drilling a tunnel in rock, said apparatus comprising a drill head comprising a drum section and at least one drilling tool, a conveying drum connected to said drill head, and a power unit positioned at a rear end of said conveying drum for supplying a forward driving force to said apparatus, the improvement which comprises at least one roller unit positioned between an exterior surface of said conveying drum and a tunnel wall for supporting said conveying drum, said at least one roller unit contacting said drum section at a first end thereof and said power unit at a second end thereof for transmitting said forward driving force from said power unit to said drill head.

2. The apparatus of claim 1 wherein said conveying drum comprises at least one tubular unit.

3. The apparatus of claim 2 wherein said at least one roller unit has a length equal to, a multiple of, or divisible by a length of said at least one tubular unit.

4. The apparatus of claim 1 wherein said roller units are joined sequentially by connecting parts.

5. The apparatus of claim 1 wherein said roller units comprise rollers or bearings.

6. The apparatus according to claim 5 wherein said conveying drum is supported in more than one direction by said rollers or bearings.

7. The apparatus of claim 1 further comprising steering cylinders positioned between said at least one roller unit and said drum section.

8. The apparatus according to claim 1 wherein said at least one tool comprises a percussion or rotatable tool.

9. The apparatus according to claim 1 wherein said conveying drum is rotatable.

* * * * *